United States Patent [19]

Bednarz

[11] 4,377,447

[45] Mar. 22, 1983

[54] METHOD FOR GRAINING METAL LITHOGRAPHIC PLATE

[76] Inventor: Joseph F. Bednarz, 287 Euclid Ave., Hackensack, N.J. 07601

[21] Appl. No.: 255,798

[22] Filed: Apr. 20, 1981

[51] Int. Cl.[3] ..... C25D 11/04; C25F 3/04

[52] U.S. Cl. ..... 204/15; 204/33; 204/129.46

[58] Field of Search ..... 204/15, 33, 224 R, 129.6, 204/129.46

[56] References Cited

U.S. PATENT DOCUMENTS 2,540,602 2/1951 Thomas ..... 204/224 R
3,102,090 8/1963 Bassi ..... 204/129.46

FOREIGN PATENT DOCUMENTS 520108 4/1940 United Kingdom ..... 204/224 R
810475 3/1959 United Kingdom ..... 204/129.46

*Primary Examiner*—T. M. Tufariello
*Attorney, Agent, or Firm*—Watts, Hoffmann, Fisher & Heinke Co.

[57] ABSTRACT

Aluminum lithographic plate stock is grained in a continuous process wherein the strip to be grained and a cloth fabric material are brought into rubbing contact in the presence of an aqueous chloride salt graining solution while an electrical potential is applied such that the strip is the anode. The product produced by the graining process has a unique porous grained finish.

17 Claims, 6 Drawing Figures

METHOD FOR GRAINING METAL LITHOGRAPHIC PLATE

DESCRIPTION

1. Technical Field

This invention relates to the lithographic art, and more particularly to a method of graining aluminum lithographic plate stock.

2. Background Art

A lithographic plate is planographic so that the process image areas are neither above nor below the non-image areas. The surface of a lithographic plate must be ink receptive or hydrophobic in the image areas and water receptive or hydrophylic in the non-image areas. On the press, the plate is continually subjected to water contact such that the non-image areas pick up water. The ink will not stick to or be picked up by these water laden surfaces as the plate comes into contact with the ink roller.

If water "beads" on the hydrophilic surface of the plate, "flooding" will occur and the water will be transferred to the surface being printed. If the plate surface does not hold moisture uniformly on the surface, the ink will begin to stick to the non-moist areas, causing a sludge or scum buildup which makes the printed image appear fuzzy or dirty.

Graining of metal lithographic plates creates a finish on the surface which collects water in the valleys of the grain. Moisture coming into contact with the grained surface is caused to flow and is retained in these valleys such that the plate holds more water without becoming flooded. Graining of metal lithographic plates is generally accomplished by mechanical or chemical methods. In one mechanical method, called ball graining, a plurality of steel balls contained on the bed of a ball graining machine contact the surface of the plate to be grained. Sand, pumice or other abrasive matter and water are added to the bed surface to create a slurry. The balls are then rotated causing minute scratches and indentations on the plate surface. The type of surface produced by this method depends largely upon the weight of the balls, their velocity and the particle size of the abrasive material. Another type of mechanical graining is commonly referred to as brush graining. In this method, brushes are substituted for the steel balls employed in the ball graining method. The brushes are caused to rotate and oscillate over the surface of the plate which is covered by the abrasive slurry. Both mechanical methods suffer the attendant problem of being rather difficult to control. Additionally the abrasions produce long fine scratches in the plate surface. These scratches cause the printed image areas to bleed into the non-image areas so that the lines of demarcation are fuzzy rather than being sharp and distinct.

In accordance with the chemical method, corrosive chemicals such as aqueous solutions of sulfuric acid or acidic soltuions of chloride salts are brought into contact with the plate surface. These methods also are difficult to control and do not create the fine uniform surface areas required in modern high speed lithographic printing processes.

Lithographic plates grained in accordance with prior art methods have been deficient in their ability to accept and bond certain coating materials required to produce the image and non-image areas. On modern presses the shear forces exerted on the plate face as a result of the coefficient of expansion tend to separate this coating from the roughened aluminum surface.

DISCLOSURE OF INVENTION

The present invention provides an improved method for treating an aluminum stock material for use as lithographic plate. More specifically, the invention is a method for treating aluminum lithographic plate stock strip in a continuous process to provide a unique porous grained surface. The treated plate may be subsequently anodized.

It has been discovered that aluminum lithographic plate stock strip can be grained by bringing the strip and a cloth fabric into rubbing contact in the presence of a graining solution comprising an aqueous solution of a chloride salt; and, applying an electrical potential having a DC component such that the strip is the anode. This treatment produces a fine, uniform, porous, grained surface which contains a hydrophylic film-like substance integrated into the porous grained surface. The treated plate can be subsequently anodized with little or no destruction of the surface texture and without affecting the hydrophylic properties of the film.

The cloth fabric, which is preferably absorbant, forms an endless loop belt which is continuously passed between the outer periphery of a rigid backing surface and the aluminum strip surface. The strip and/or the belt are moved at different relative speeds to accomplish the critical rubbing contact between the cloth fabric and the strip surface.

The graining solution is applied directly to the cloth fabric. In order to assure a clean reaction surface after contacting the strip, the cloth fabric is cleaned by application of a cleansing solution applied directly to the cloth. Fresh graining solution is then applied to the cloth fabric prior to the cloth fabric again contacting the strip. It has been found that the graining solution can be easily applied to the cloth by dipping or immersion. However, this method is not preferred in that the solution bath creates a conductive medium through which the applied graining current passes, thus creating stray currents within the system. The preferred method of applying the graining solution is by spraying.

In accordance with a further aspect of the invention, the grained strip may be anodized in a continuous process wherein the grained strip material is passed over a lead coated backing surface containing an anodizing solution-laden cloth fabric. An electric potential having a DC component is applied such that the grained strip is the anode.

The cloth fabric is brought into rubbing contact with the strip as fresh solution is continuously provided to the contacting area. In an exemplary arrangement, the cloth fabric forms an endless loop which continually passes over the periphery of a perforated, lead coated, metal backing drum while the strip material is contacted with the cloth fabric on the face of the drum.

In order to assure a clean reaction surface at the contact interface between the cloth fabric and the strip material, the cloth is cleansed subsequent to contacting the strip, and fresh anodizing solution applied prior to the cloth again contacting the strip. The anodizing solution can be easily applied to the cloth fabric by spraying.

Utilization of this embodiment allows for a single continuous graining and anodizing process wherein the anodizing is accomplished without the use of conventional immersion-type tanks and the problems of handling acid. The anodizing cycle can be carried out much quicker than known prior art anodizing techniques.

BEST MODE FOR CARRYING OUT THE INVENTION

Figure 1:
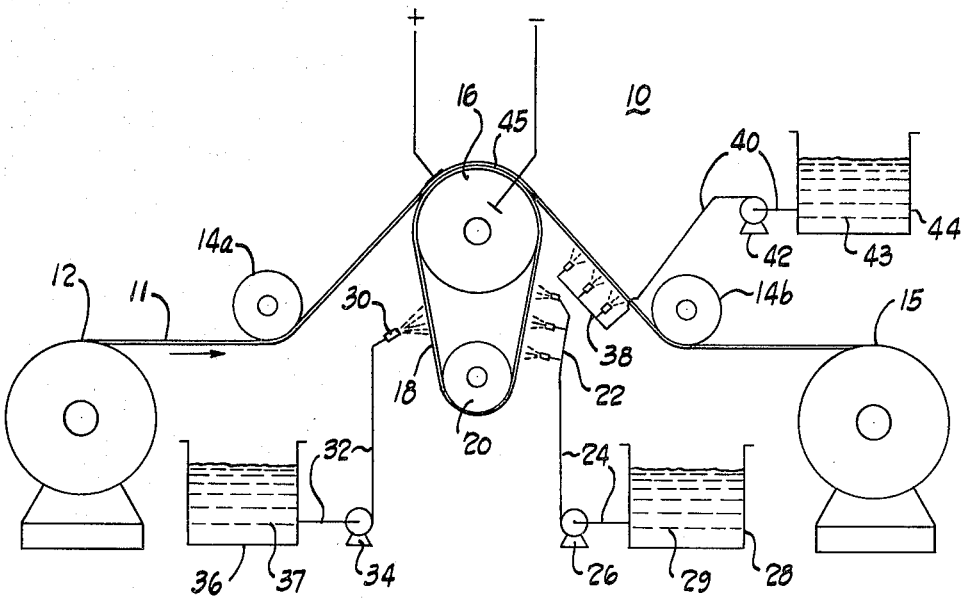
FIG. 1 is a schematic drawing of an apparatus for carrying out the graining process of the instant invention.

Referring now to the drawings, and FIG. 1 in particular, reference numeral 10 designates an apparatus for graining aluminum lithographic plate stock strip 11 in a continuous line process in accordance with the invention. Apparatus 10 has a feed reel 12, a backing drum 16 disposed between a pair of guide rollers 14*a*, 14*b* and a take-up reel 15. The strip 11 is continuously fed from the reel 12 over the drum 16 between the rollers 14*a*, 14*b* to the take-up reel 15. A belt 18 forms an endless loop around the drum 16 and a drive roller 20. The belt 18, which is of an absorbant, flexible fabric material such as a cloth fabric or the like, is driven by the roller 20 and passes between the lower surface of the strip 11 and the outer surface of the drum 16 to form a contact zone 45.

A graining solution nozzle 30 is situated adjacent the belt 18 to apply a graining solution 37, such as an aqueous chloride salt solution, to the belt 18 prior to its entering the contact zone 45. The nozzle 30 is connected by a conduit 32 and a pump 34 to a heated reservoir 36 that contains the graining solution 37.

Cleansing solution nozzles 22 are situated adjacent the belt 18 to apply a cleansing solution 29, such as water or the like to the belt 18 as the belt exits the contact zone 45. The nozzles 22 are connected by a conduit 24 and a pump 26 to a reservoir 28 that contains the cleansing solution 29.

The treated surface of the strip is washed downstream of the contact zone 45. Metal cleansing solution nozzles 38 are disposed adjacent the treated underside of the strip 11 to apply a metal cleansing solution 43. The nozzles 38 are connected by a conduit 40 and a pump 42 to a reservoir 44 that contains the metal cleansing solution 43.

Figure 2:
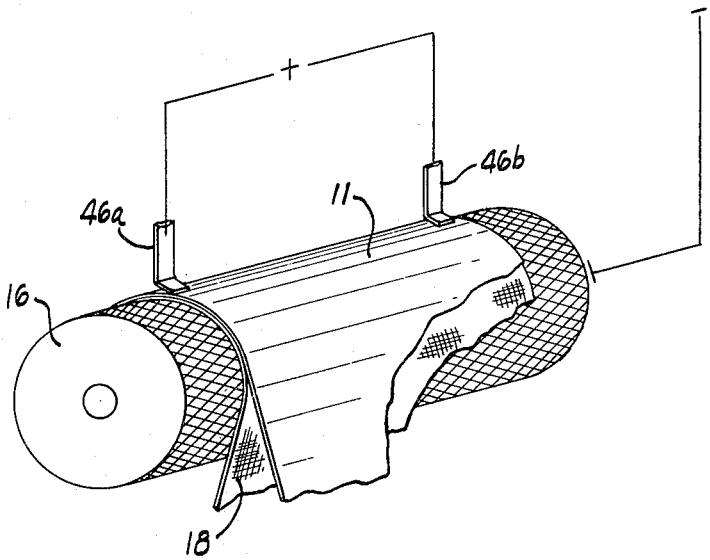
FIG. 2 is an illustration of a perforated backing drum embodied in the apparatus of FIG. 1.

A DC power source (not shown) provides an electrical potential between the drum 16 as the cathode and the aluminum strip 11 as the anode. As shown in FIG. 2, the drum 16 is attached to the negative terminal of the power source while contacts 46*a* and 46*b* are connected to the positive terminal of the power source and brought into contact with the non-reacted or back side of the aluminum strip 11 to render it anodic.

The drum 16 acts as a backing surface when the belt 18 is brought into rubbing contact with the strip 11 in the contact zone 45. By rubbing as that term is used herein, it is meant a frictional engaging or contact with no substantial removal of material from the metal surfaces. In the illustrated form of the invention, the drum 16 is made of a conducting material such as stainless steel or the like. In one embodiment the drum is perforated to allow excess graining solution 37 and reaction products to drain from the contact zone 45. In alternative constructions the belt 18 may be backed by an expanded metal drum, a metal belt, a fixed bed or the like. In employing a fixed bed, which may or may not be perforated, the backing surface remains stationary, while the belt 18 is caused to move over the fixed surface.

Fresh graining solution 37, applied by nozzles 30, is continuously carried by the belt 18 to the contact zone 45. The belt 18 is driven by the roller 20 so that it has a surface speed that is either greater or less than that of the strip 11 to provide the desired rubbing contact throughout the contact zone 45. The belt 18 is sufficiently absorbant to carry the graining solution to the contact zone 45. It can be of natural fibers such as wool, cotton and the like as well as synthetic materials such as polyesters, or polyacrylics. It will be realized that any absorbant web material which will withstand the reaction conditions can be utilized. Although any absorbant material is useful, materials of an organic origin are found particularly useful and may provide a source for carbon which enhances the production of a uniform, well adhered polymeric film.

The graining solution 37 can be of any aqueous solution of a chloride salt and is preferably sodium chloride for economical reasons. Useful chloride salts include potassium chloride, calcium chloride and magnesium chloride. Other chloride salts which are useful include nickel chloride, chromium chloride, tin chloride and iron chloride. When sodium chloride is used, concentrations of from about 0.2 to about 10 grams per gallon of water have been found acceptable with from about 1 to 2 grams of sodium chloride per gallon of water being preferred. Talcs, lipori, chalks, bentonites, quartzes, pumices, sands, and the like as well as amine complexes, proteins, alums, citrates, carbonates and other color producing additives can be added to the graining solution to enhance the coarseness or smoothness of the plate or give it a film of a particular color. In order to enhance the chemical reaction between the graining solution 37 and the strip 11, the graining solution may be heated, for example, to a temperature in the range from about 90° l F. to about 180° F.

In carrying out the invention, the electric potential applied to the drum 16 and the strip 11 ranges from about 10 to about 50 volts DC with 18 volts DC being preferred. The actual voltage will depend upon such factors as the concentration of the graining solution used, the composition of the aluminum strip, the temperature of the graining solution, the thickness of the cloth fabric, etc.

The strip 11 is in rubbing contact with the graining solution laden belt 18 from about 5 seconds up to several minutes depending on such factors as the character and thickness of the graining surface desired, the currents utilized, the material utilized for the belt and the production speeds. The typical contact time is in the range of about 30 seconds. If desired the contact time can be interrupted or the strip 11 can be run over a series of belts 18 in order to increase production speeds.

As the belt 18 exits the contact zone 45, it contains unused graining solution and reaction products. The belt 18 is cleansed by application of the cleansing solution 29 applied to the belt 18 through the nozzles 22. As the belt 18 continues around drive roller 20, but prior to again entering the contact zone 45, fresh graining solution 37 is applied to the belt 18 through the nozzle 30. As a result of the graining solution being continuously renewed and reaction products being continuously renewed, the cell parameters remain substantially constant and the quality control is excellent. The reaction is continuous and uniform.

The reacted surface of the strip 11 is cleaned as it exits the contact zone 45 by spraying the metal cleansing solution 43 onto the strip surface through the nozzles 38. The cleansing solution, which may be water but is preferably caustic or acidic, removes the reaction product so that a uniform quality product is obtained.

The foregoing process renders the surface of the strip 11 hydrophylic and achieves a unique porous, grained structure. The porous, grained surface is characterized in part by uniformly disposed, fine pin-point type grains or pores on the order of onehalf million per square inch. The surface of the strip 11 is further characterized by the presence of a hydrophilic film which is integrated into the porous grained surface.

Figure 4:
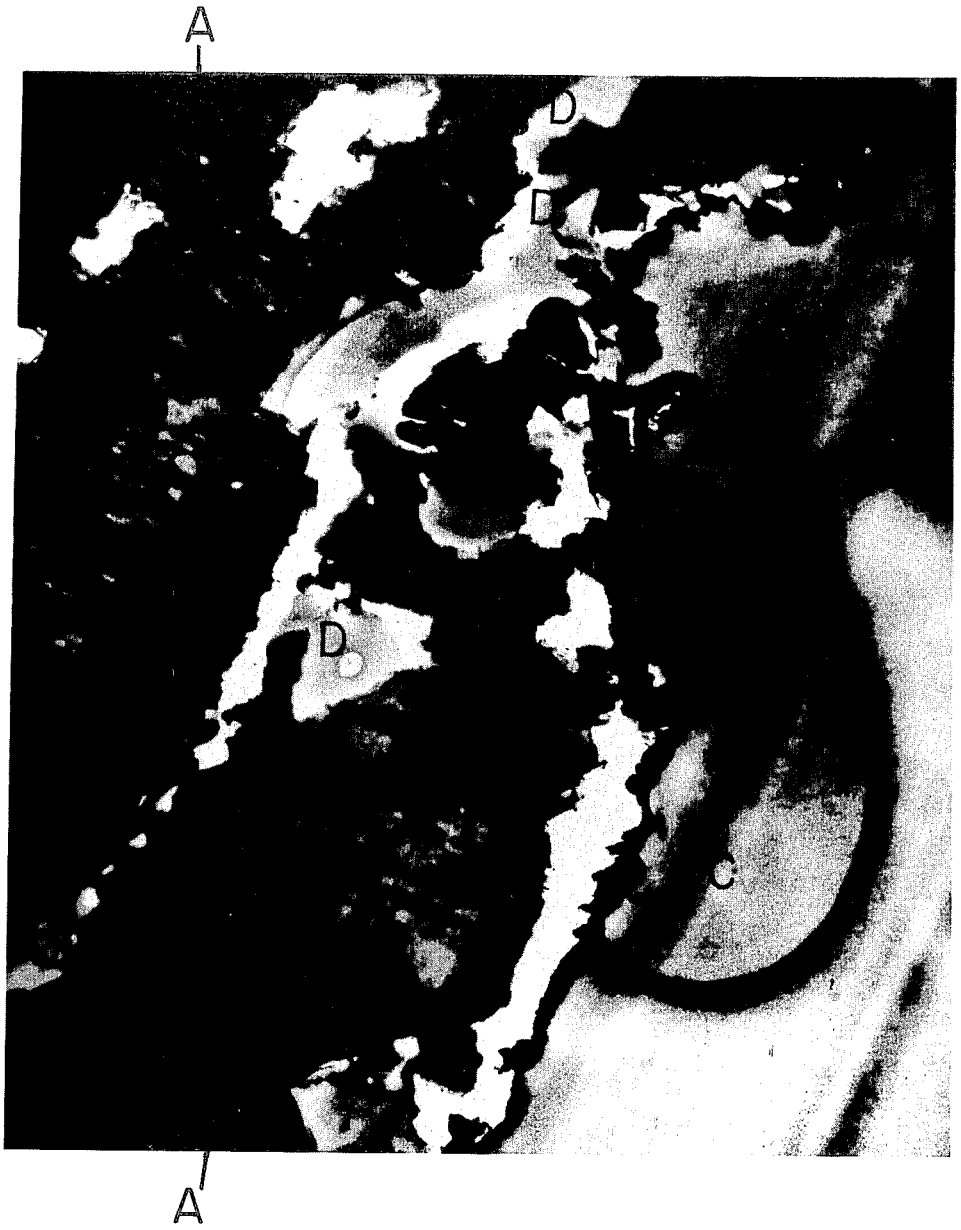
FIG. 4 is a micrograph of a sample of a grained aluminum article prepared in accordance with the invention.

The film material is shown in FIG. 4 which is a micrograph taken by Transmission Electron Microscopy (TEM) at 25,000 X of a sample of a grained aluminum article prepared in accordance with the invention. The sample, taken from the edge of the grained article, is coated with a 60% Au-40% Pd alloy and embedded in an epoxy media for handling purposes. TEM photographs were taken of this section to characterize the surface areas of interest. In FIG. 4, reference character A is the aluminum substrate, reference character B the embedding media, the reference character C the metallized surface of the sample. The areas designated by reference character D are the film. The areas D have been determined by Auger Electron Spectroscopy (AES) to have carbon, nitrogen, oxygen, and probably hydrogen components but no chlorine. A disruption in the aluminum structure on the AES data suggests that the film material D may be chemically bonded to the aluminum substrate. The presence of carbon, oxygen and hydrogen and the fact that the film D holds tenaciously to the surface of the aluminum and is almost insoluble indicate that the film is a chemically bonded compound of a polymeric material. Subsequent applications of photosensitizers and appropriate chemicals to develop an image on plates processed in accordance with the invention further demonstrate that the film material is hydrophillic.

Figure 5:
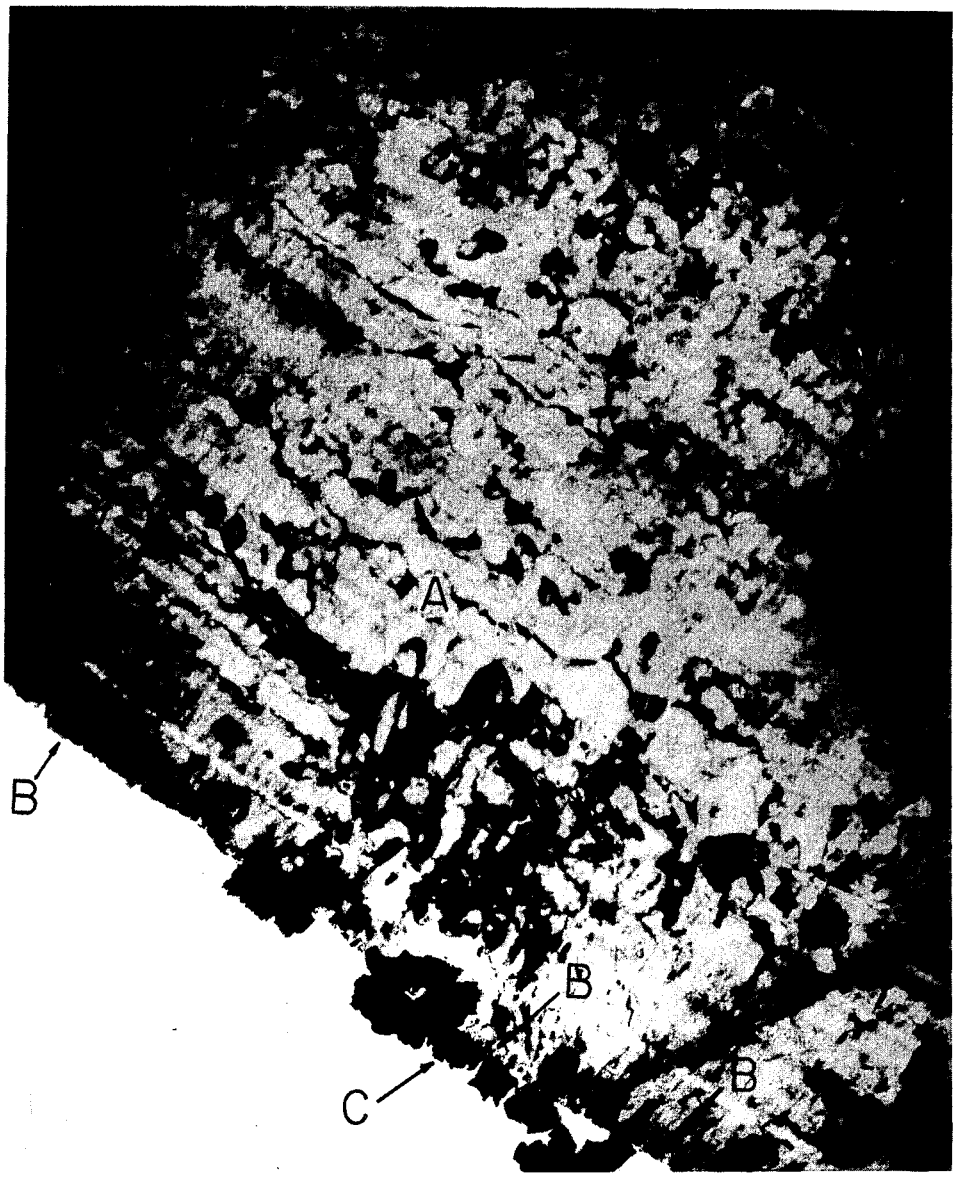
FIG. 5 is a micrograph of a clean aluminum substrate.

FIG. 5 is a micrograph taken by TEM at 50,000X of a non-treated, clean aluminum substrate surface sample prepared in accordance with the method of preparation of the micrograph shown in FIG. 4 except that the sample was not embedded in an embedding media. In FIG. 5 reference character A is the aluminum substrate, reference character B is an oxide coating, reference character C is the Au-Pd alloy layer. There is noticably an absence of the film material designated as D in FIG. 4.

The mechanism responsible for the formation of the film D is not fully understood, but it is believed that sodium hydroxide and aluminum trichloride are formed in the contact zone 45. Aluminum trichlorides are known to act as a catalyst in the formation of many organic compounds. In the exothermic heat of the aluminum reaction, carbon, oxygen, and hydrogen combine to form the organic film which is integrated into the porous grained surface of the treated plate. The formed film material on the grained plate which is hydrophylic, wets very evenly to produce a high quality lithographic plate which minimizes flooding.

The lithographic plate produced in accordance with the instant invention resists shearing on the press. The porous grained surface having the polymeric film integrated therein resists the shear force exerted by the coefficient of expansion experienced on modern high-speed presses. The hydrophylic properties of the film material enhance the printing quality of the plate since the surface absorbs more water to keep the plate from drying, wets more evenly, and thus allows the plate to be cleaner during printing.

Figure 3:
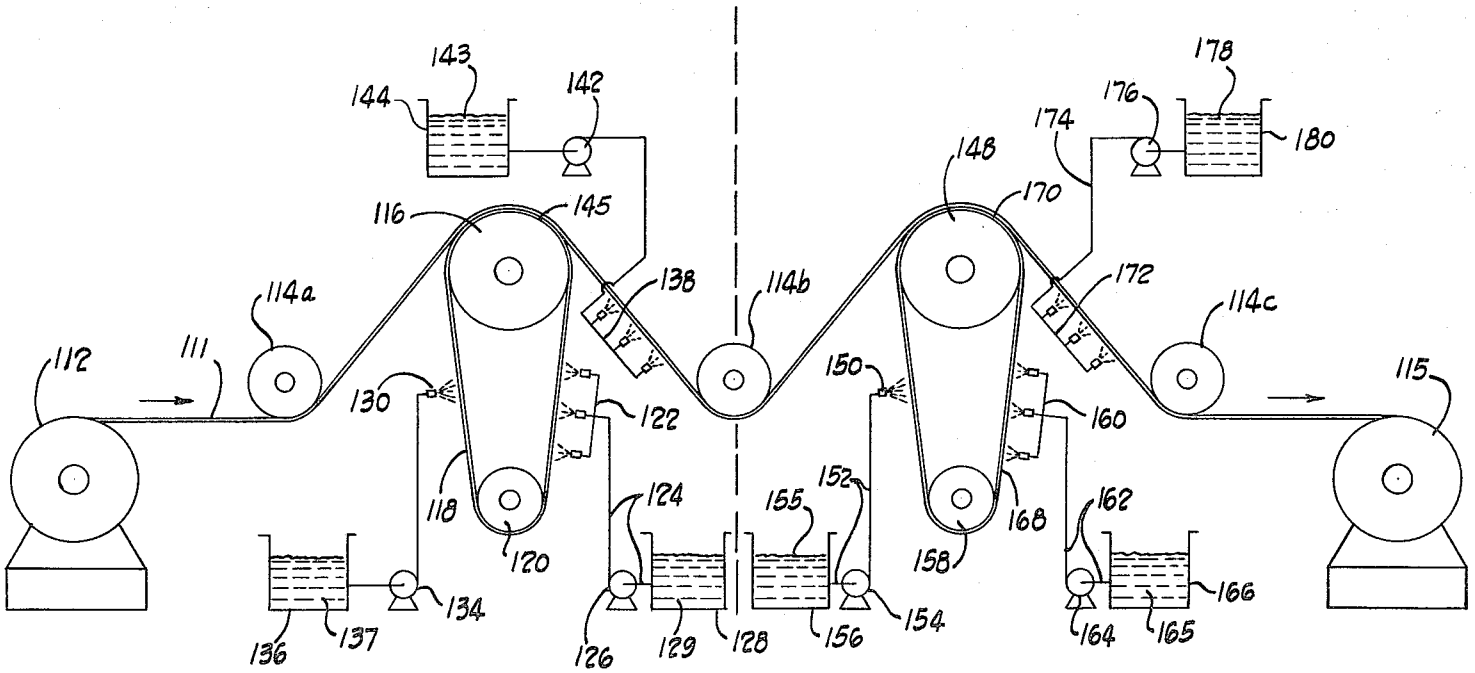
FIG. 3 is a schematic drawing of an apparatus for continuously graining and anodizing aluminum lithographic plate in accordance with the instant invention.

Once the graining process has been completed, the metal strip 11 is preferably anodized in order to harden the surface and provide a more durable printing plate. A preferred apparatus for graining and anodizing an aluminum strip in a continuous line process is shown in FIG. 3. In FIG. 3 the graining portion of the apparatus is identical to that described in connection with FIGS. 1 and 2 and is designated by the corresponding 100 series of reference numerals.

A belt 168 which corresponds to the belt 118 is passed between the lower surface of a strip 111 and the outer surface of a drum 148, which forms a contact zone 170, and around a drive roller 158. The drum 148 is preferably of a perforated electrically conductive metal which is lead coated and which acts as a cathode in the electrolytic anodizing reaction.

Anodizing solution 155, which is a dilute aqueous solution of sulfuric and/or oxalic acid, is applied to the belt 168 in a suitable manner, as by spraying through a nozzle 150. The nozzle 150 is connected by a conduit 152 and a pump 154 to a reservoir 156. As in the graining portion of the apparatus, the belt 168 is preferably cleaned of excess anodizing solution and reaction products by a cleansing solution 165 which is applied to the belt by spray nozzles 160. The nozzles 160 are connected to a reservoir 166 through a conduit 162 to a pump 164.

In carrying out the anodizing operation, a direct current source is connected to the strip 111 as the anode and the drum 148 as the cathode to provide a direct electrical potential therebetween of from about 15 to about 20 volts and more preferably about 18 volts. The concentration of the aqueous acid anodizing solution 155 contains about 15% sulfuric acid by volume. The solution 155 is applied to the belt 168 at a temperature of about 70°±2° F. The anodizing reaction is very exothermic.

As the anodized strip 111 exits the contact zone 170, the anodized surface is cleaned with a metal cleansing solution 178. The metal cleansing solution 178 contained in the reservoir 180 is applied to the anodized surface by means of nozzles 172 which are connected to a reservoir 180 by a conduit 174 and a pump 176.

The result of the anodizing process is the formation of a commercial grade anodic surface through the build up of aluminum oxide on the surface of the aluminum substrate to form a protective finish. The anodizing accomplished in accordance with the instant process is more rapid than with conventional immersion methods. In the combined process the strip can be grained and anodized continuously in one sequential process.

Figure 6:
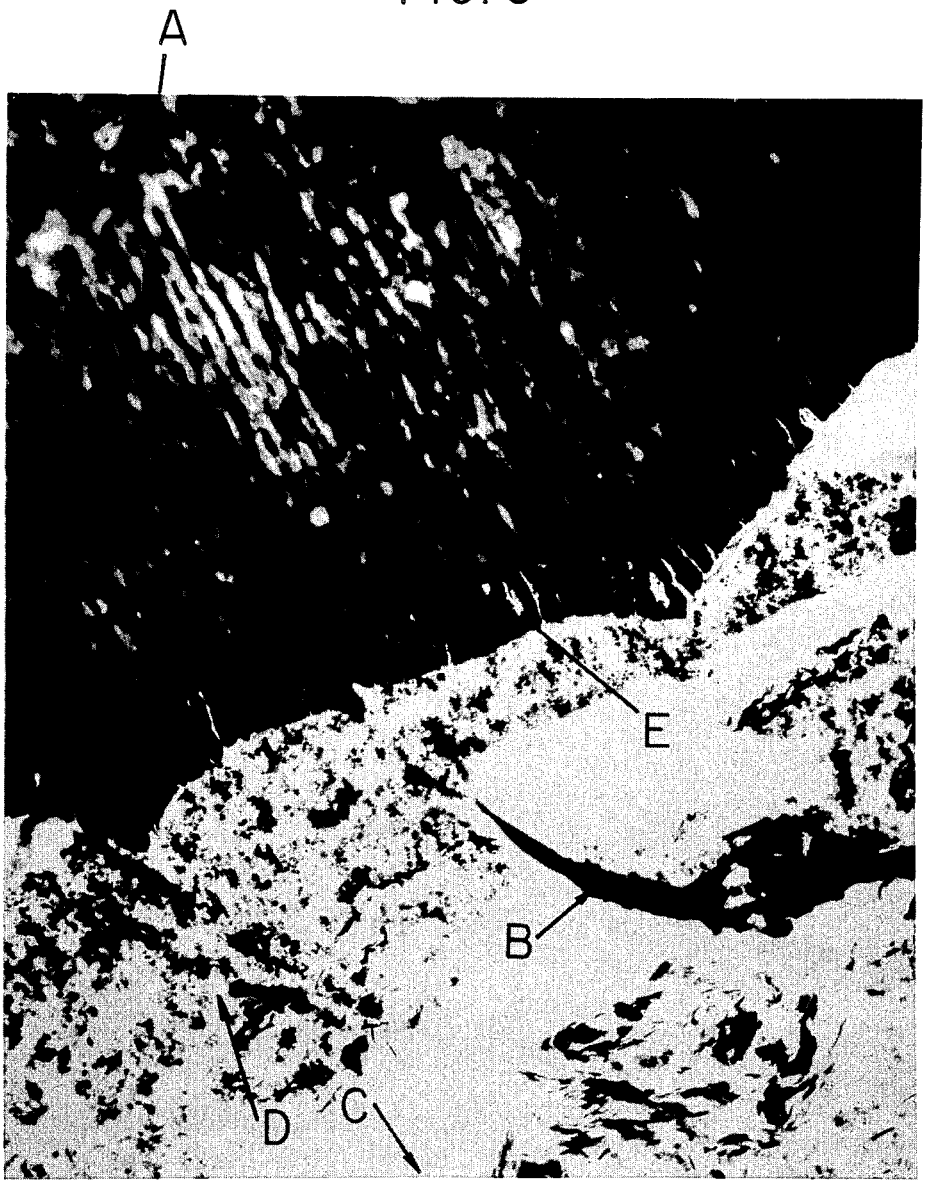
FIG. 6 is a micrograph of a sample of a grained and anodized article prepared in accordance with a further aspect of the invention.

FIG. 6 is a TEM micrograph of a sample of aluminum material grained and anodized in accordance with the present invention. The sample was prepared in the manner described in connection with FIG. 4. Reference character A is the aluminum substrate, reference character B the Au-Pd alloy and reference character C the embedding media. The areas of interest are designated by reference characters D and E. Reference character D indicates the film and reference character E the anodic coating.

The strip contained on take up reel 115 is cut into plates of the desired size which can be provided with commercial coatings according to conventional techniques depending on whether positive or negative plates are desired. The uniformly and evenly anodized product containing a fine porous grained surface, has excellent printing qualities and is shown to reduce likelihood of sludge buildup on the plate.

The following examples are given by way of illustration of the nature of the instant invention but are not intended to be limitations on the scope thereof.

EXAMPLE I

In this example a No. 1100 (99% aluminum) plate stock strip was successfully grained in accordance with the instant invention utilizing an apparatus similar to that described in connection with FIG. 1. The belt 18 was a wool fabric. The graining solution was an aqueous solution containing 2 grams of NaCl per gallon of water, and was maintained at a temperature of 180° F. within the reservoir 36. A voltage of 18 volts DC was applied between the drum 16 and the strip 11. The speed of the strip 11 and the cloth 18 over the drum 16 were maintained at different velocities in order to assure continuous rubbing contact.

After the aluminum strip had been in contact with the graining solution-soaked cloth for 30 seconds, the resulting lithographic plate was evaluated in a lithographic printing process. The plate had a very fine finish and produced an excellent printed image.

EXAMPLE II

In this example the apparatus used was substantially identical to that used in Example I except that a steel belt having a tank tread design was used as the backing surface for belt 18. As shown in Table 1, two runs were made. In run A, the continuous cloth belt 18 was made of a polyester material and contacted the aluminum strip for 90 seconds. In run B, cloth belt 18 was made of wool and contacted the aluminum strip for only 5 seconds.

TABLE III

| | A | B |
|---|---|---|
| Metal Alloy | 1100 | 1100 |
| Metal Temperature | 80° F. | 100° F. |
| Graining Solution | 2 gram NaCl/ gal $H_2O$ | 2 gram NaCl/ gal $H_2O$ |
| Solution Temperature | 150° F. | 120° F. |
| Cloth | Polyester | Wool |
| Voltage | 18 volts | 18 volts |
| Contact Time | 90 seconds | 5 seconds |

The lithographic plate produced in run A had a coarse grained surface which proved to be very receptive to water and ink. The printed image produced using the plate was excellent and withstood long printing runs without wear. The lithographic plate produced in run B had a very fine grained surface which produced a good, long lasting image.

The example shows the use of alternate backing surfaces and the use of various cloth materials in the practice of the instant invention.

EXAMPLE III

In this example the apparatus of FIG. 1 was varied by using an expanded steel drum rather than a perforated steel drum as a backing surface. As shown in Table 2, an aluminum alloy No. 3003 (about 1% manganese) was grained in both runs. The continuous cloth belt 18 made of a polyester underlaid with asbestos was used in each case.

TABLE 2

| | C | D |
|---|---|---|
| Metal Alloy | 3003 | 3003 |
| Metal Temperature | 70° F. | 70° F. |
| Graining Solution | 10 gram NaCl/ gal $H_2O$ | 10 gram NaCl/ gal $H_2O$ |
| Temperature Solution | 100–110° F. | 100–110° F. |
| Cloth | Polyester over Asbestos | Polyester over Asbestos |
| Voltage | 18 volts | 18 volts |
| Contact Time | 10 min | 10 min. |

The two runs C and D were carried out under conditions indicated in Table 2. The lithographic plate produced in each run had a uniform gray surface with very good finish. The plate from run C was used on a press with excellent results. The plate from run D was used for color separation plates and produced very good images.

EXAMPLE IV

In this example, the test apparatus was substantially similar to that used in Example I except that a steel bed was used as a backing surface for belt 18. A metal strip of aluminum alloy No. 5005 (a roofing material) was grained using a cloth belt of a synthetic material underlaid with asbestos. The chloride salt concentration in the graining solution varied from about 10 to about 20 grams of NaCl per gallon of water. The graining solution temperature was maintained between 100° F. and 120° F. The rubbing contact was accomplished in a discontinuous manner with frequent starting and stopping of the strip 11 and belt 18. The total contact between the strip and the cloth ranged from 1½ to 3 minutes.

The lithographic plate produced in accordance with this example exhibited a non-uniform finish with gray grained portions visible to the naked eye.

While the invention has been explained in relation to its preferred embodiment, it is understood that various modifications thereof will become apparent to those skilled in the art upon reading the specification and it is intended to cover such modifications as fall within the scope of the appended claims.

I claim:

1. A method useful for graining aluminum strip for use as lithographic plate comprising the steps of bringing the strip and a cloth fabric into rubbing contact over a metal backing member while applying an aqueous chloride salt solution to the surface of the strip; moving the strip and the fabric relative to each other while in contact to remove reaction products from the strip surface and expose fresh surface area to the solution; and, establishing an electrical potential between the backing member as the cathode and the strip as the anode.

2. The product produced by the process of claim 1.

3. The method of claim 1 wherein said aqueous chloride salt solution is applied directly to the cloth fabric and is carried by the fabric into contact with the strip.

4. The method of claim 1 or 3 wherein said strip and said fabric are in motion at relative speeds which are different one from the other.

5. The method of claim 1, or 3, wherein said fabric material is an endless loop and comprising the further steps of cleansing said fabric subsequent to the rubbing contact and then applying fresh aqueous chloride salt solution to the fabric material.

6. The method of claim 1 or 3, wherein said chloride salt solution is sodium chloride and is applied to the cloth by means of spraying.

7. The method of claim 1 further comprising the step of subsequently electrolytically anodizing the strip.

8. A method for graining aluminum strip for use as lithographic plate comprising the steps of:

(a) applying a graining solution comprising an aqueous solution of a chloride salt to a cloth fabric;

(b) bringing the strip and the fabric into contact over a rigid electrically conducting backing surface;

(c) moving the strip and the fabric relative to each other while in contact to at least partially remove reaction products from the strip;

(d) applying a direct electrical potential between the backing surface as the cathode and the strip as the anode.

9. The method of claim 8 wherein said fabric is an endless loop and comprising the further steps of cleaning the fabric subsequent to bringing the strip and the fabric into contact and then applying fresh graining solution to the fabric.

10. The method of claim 8 wherein said chloride salt is selected from the group consisting of potassium chloride, calcium chloride, magnesium chloride, iron cloride, and chromium chloride, nickel chloride, tin chloride, and sodium chloride.

11. The method of claim 10 wherein said chloride salt is sodium chloride.

12. The method of claim 9 wherein said graining solution comprises an aqueous solution of sodium chloride in concentrations of from about 0.5 to about 20.0 grams per gallon of water and is applied to the fabric at temperatures in the range of from about 90° F. to about 180° F.

13. The method of claim 12 wherein the applied voltage between the backing surface and the strip is from about 10 to about 50 volts DC.

14. The method of claim 9 or 13 wherein the graining solution is applied to the fabric by means of spraying.

15. The method of claim 8 further comprising step of subsequently electrolytically anodizing the grained strip.

16. A method of producing an anodized grained lithographic plate from an aluminum lithographic plate stock strip comprising the steps of:

(a) producing a grained strip by moving the strip and a cloth fabric relative to each other while in frictional contact in the presence of an aqueous chloride salt solution; and, applying an electrical potential having a DC component such that the strip is the anode; and thereafter, (b) anodizing the grained strip by moving the grained strip and a cloth fabric relative to each other while in frictional contact in the presence of an anodizing solution; and, applying an electrical potential having a DC component such that the grained strip is the anode.

17. The product produced by the process of claim 16.

* * * * *